United States Patent [19]

McIntyre et al.

[11] Patent Number: 4,759,840

[45] Date of Patent: Jul. 26, 1988

[54] PARTICLE CLASSIFIER

[75] Inventors: Wallace J. McIntyre; John H. Gottschalk, both of Goderich, Canada

[73] Assignee: Domtar Inc., Montreal, Canada

[21] Appl. No.: 919,585

[22] Filed: Oct. 16, 1986

Related U.S. Application Data

[63] Continuation of Ser. No. 714,902, Mar. 22, 1985, abandoned.

[51] Int. Cl.[4] ..... B07B 4/02

[52] U.S. Cl. ..... 209/135; 209/147; 209/33

[58] Field of Search ..... 209/134, 135, 32, 33, 209/24, 25, 147

[56] References Cited

U.S. PATENT DOCUMENTS

| | | | |
|---|---|---|---|
| 2,684 | 6/1842 | Wilson | 209/135 |
| 734,761 | 7/1903 | Smith | 209/135 |
| 1,052,301 | 2/1913 | Zion | 209/135 |
| 1,903,046 | 3/1933 | Hunter | 209/135 |
| 2,384,891 | 9/1945 | Collins | 209/135 |
| 2,389,966 | 11/1945 | Erickson | 209/25 |
| 2,828,011 | 3/1958 | Whitby | 209/135 |
| 2,978,103 | 4/1961 | Cowher | 209/135 |
| 3,856,217 | 12/1974 | Brewer | 209/135 |
| 4,213,852 | 7/1980 | Etkin | 209/136 |
| 4,242,197 | 12/1980 | Voelskow | 209/135 |

FOREIGN PATENT DOCUMENTS

| | | | |
|---|---|---|---|
| 424698 | 2/1923 | Fed. Rep. of Germany | 209/135 |

*Primary Examiner*—Kenneth M. Schor
*Assistant Examiner*—Thomas M. Lithgow
*Attorney, Agent, or Firm*—Antoine H. Gauvin

[57] ABSTRACT

A device for simultaneously separating cohesively bonded particles, by the action of a turbulent air stream, and classifying them according to their size, the device has a horizontal hood connected to the upstream and downstream air ducts. Equipped with an air fan, the upstream air duct has a converging section to accelerate a stream of air. Feed hoppers distribute the particles into the upstream end of the hood where they are separated and classified. Collecting devices are below the hood to receive the classified particles. A recirculating air duct is disclosed including a built-in filter device. A method is also disclosed for simultaneously separating cohesively bonded particles and classifying them according to their size.

1 Claim, 1 Drawing Sheet

PARTICLE CLASSIFIER

This application is a continuation of application Ser. No. 714,902, filed Mar. 22, 1985 now abandoned.

This invention relates to an apparatus and a method classifying particles, and particularly to an apparatus for fragmenting cohesively bonded particles and to classify the fragmented particles according to their size.

BACKGROUND OF INVENTION

In order to classify particles, screens are generally used. Another method involves the use of laminar flows. For instance, in U.S. Pat. No. 3,385,436 as invented by Murphy and U.S. Pat. 3,933,626 as invented by Stukel, uniform particles are fed into a low velocity laminar diffuse flow of air. Upon entering the laminar flow of air, the now uniform particles follow a trajectory like path toward collection containers. In such classifying devices, employing diffuse laminar flow, air lock containers or valves are commonly employed to isolate the diffuse laminar flow field, within the classifier, from exterior disturbances.

Although suitable for particulate mixtures having good flowing characteristics and non-cohesively bonded particles, classifiers disclosed to date are unsuitable for particulate mixtures of the type having poor flowing characteristics due to, among other characteristics, cohesively bonded particles.

By the expression "good flowing characteristics" used hereinabove is meant, those characteristics of a mixture whose particles have substantially little or no attraction to one another due to electrical static, adhesion, moisture, irregularities in particle surface or other cause, thereby having substantially free relative movement. Such characteristics are important when a mixture of particles flows from a hopper whose outlet is significantly smaller than the outlet. Examples of "good flowing characteristics" include dryness and smooth particle surfaces.

Cohesively bonded particles in such mixtures, are not broken apart or fragmented, and hence are not classified according to their individual sizes. Furthermore, such mixtures block air lock devices located at the various classified particle collection points, resulting in expensive and frequent maintenance procedures.

BRIEF DESCRIPTION OF THE PRESENT INVENTION

It is the object of the present invention, to overcome the above problems by providing a classifier for particle mixtures having poor flowing characteristics and a portion thereof being cohesively bonded particles. It is also the object of the present invention to provide a classifier capable of transfering classified or uniform particles to a collection container without the need of air lock devices, thereby being suitable for industrial applications requiring classification at high volume rates.

Broadly stated, the invention comprises; an apparatus to simultaneously separate cohesively bonded particles and to classify the particles according to their size, comprising: a hood having sides and upper wall portions defining a passage, said passage being perpendicularly oriented with respect to gravity, a means to generate near one end of said passage, a high velocity stream of air, a means for feeding near said upper wall portion and near said one end, cohesively bonded particles into said passage, whereby said high velocity, inherently generating turbulence in said passage, impinges upon said bonded particles to fragment them into particles, said air and said particles being confined by said wall portions, and whereupon further displacement the particles proceed into a zone whereby the downward curved trajectory of each of said particles is basically a function of the air velocity and of the gravitational force on each of said particles thereby allowing the individual trajectory of each of said particles to be a function of the particle size, and a means for collecting said particles in space relationship with said individual trajectories for receiving each particle according to its size.

The invention is also directed to a method of fragmenting cohesively bonded particles into particles and classifying them according to their size; said method comprising: generating a high velocity turbulent stream of air having defined a Reynold's number of at least 4000 and a mean velocity ranging from 15 to 35 feet per second, directing said turbulent stream substantially perpendicular to gravity, feeding at least a portion of cohesively bonded particles across said turbulent stream to fragment them into particles by means thereof; said turbulent stream further displacing said particles to classify them as to allow each of said particles to define respectively a downward curved trajectory according to its size, in reaction to gravity and to said turbulent stream, all of said trajectories being gradiently disposed according to particle size, and collecting near said trajectories, said particles indicative of size range, selecting at least a portion of said trajectories to collect at least a portion of said particles associated in size with said trajectories.

In one of the preferred embodiments, the means to generate a high velocity is positioned at the one end of said passage, in the upper portion thereof to enable a first upper zone having high velocity and thereby inherent turbulence and a lower zone of lower velocity, to improve particle size classification.

By "cohesively bonded particles" throughout the disclosure and claims is meant those particles having weak adherence due to compaction, moisture, irregular surface characteristics and the like.

The invention is particularly suited to mine extracted particle mixtures, such as feed-salt and ores, generally having cohesively bonded particles that require fragmenting in order to be individually classified with respect to particle size.

BRIEF DESCRIPTION OF THE DRAWINGS

Further features, objects and advantages will be evident in the following detailed description of the preferred embodiment of the present invention taken in conjunction with the accompanying drawings, which illustrates embodiments of the invention and in which.

Figures 1, 2:
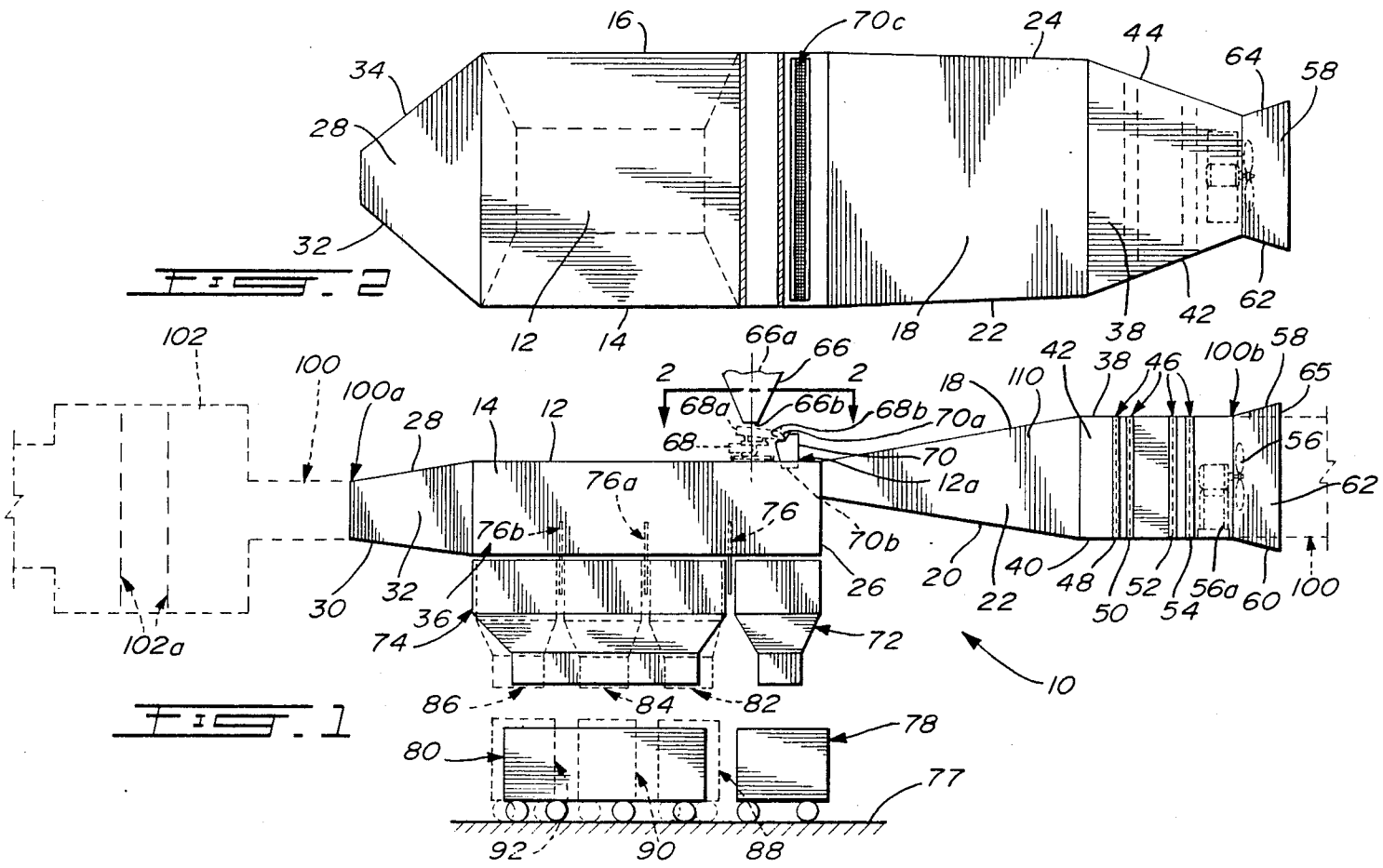
FIG. 1 is a schematic side view of a particle classifier.
FIG. 2 is a top view of the classifier with the hopper sectioned with respect to line 2—2 in FIG. 1.

Now, referring to FIG. 1, the non-uniform particle classifier 10 comprises a large U-shaped rectangular elongated hood defined by top wall 12 and side walls 14 and 16 (16 shown in FIG. 2). The top wall 12 has a walled portion removed therefrom to form aperture 12*a*, located at one end of the wall 12 and forming therein a passage to link the region adjacent the outside of top wall 12 to the inner region of the hood, for feeding in particles. Coupled to walls 12, 14, 16 of the large hood is the outlet of the converging duct defined by the walls 18, 20, 22 and 24 (24 shown in FIG. 2) thereby defining the upstream end of the large hood. Preferably, the converging duct has an outlet area smaller than the inlet area to create turbulence.

In a particular embodiment as in FIG. 1, the converging duct is coupled to the upper portion of the large hood to generate a flow of gradially decreasing velocity decreasing in the downward direction to increase particle classification therein, as will be described hereinbelow.

Wall 26 is sealably coupled to side walls 14 and 16 of the large hood and the wall 20 of the converging duct. The downstream end of the large hood is coupled with an outlet duct, defined by top and bottom walls 28 and 30 respectively and side walls 32 and 34 (wall 34 shown in FIG. 2). The lower edge of walls 14, 16 (of the large hood), 26 and 30 (of the outlet duct) define aperture 36. The rear duct, defined by top and bottom walls 38 and 40 respectively and side walls 42 and 44 (shown in FIG. 2), is sealably coupled with the respective walls of the converging duct. The rear duct is divergent, having a downstream end with a larger area than that of the upstream end. Apertures shown at 46 in walls 42 and 44 are provided for insertion of diffusing screens 48, 50, 52 and 54 into the rear duct, if desired.

Fan 56 is mounted on the bottom wall 40 of the rear duct by means of frame 56*a*. The protective guard, defined by the walls 58, 60, 62 and 64 (wall 64 shown in FIG. 2) and protective screen 65 covering the aperture formed by the walls, is sealably mounted on the respective walls of the rear duct.

Positioned above the wall 12 of the large hood and near the aperture 12*a* located therein, is a particle hopper 66 having inlet 66*a* and outlet 66*b*. Positioned below the receiving hopper 66 is an agitating feeder 68 with feeding tray 68*a*. The upper region of tray 68*a* is aligned with the outlet 66*b* of hopper 66. Interposed of the lower exiting edge 68*b* of tray 68*a* and the aperture 12*a* is second receiving hopper 70. The inlet 70*a* of the second hopper 70 is below the lower tray edge 68*b* while the outlet 70*b*, including screen 70*c* (shown in FIG. 2) is just inside the large hood through aperture 12*a*.

If desired, aperture 36 links the inner region of the large hood to the outer region immediately below the hood.

Positioned in tandem below the aperture 36 of the large hood and mounted on a frame (not shown), are the upstream and downstream rectangular funnel-like chutes 72 and 74. If desired, outlets are provided for closing the funnel-like chutes. Also, the funnel-like chutes may be sealably coupled to the large hood, if desired. Interposed of upstream chute 72 and downstream chute 74 and slidably mounted on a frame (not shown) is particle deflection barrier 76.

Located below the upstream funnel-like chute 72 on surface 77 is upstream uniform particle receiving wagon 78. Similarly, the downstream uniform particle receiving wagon 80 is positioned below the downstream funnel-like chute 74.

Alternatively, a plurality of funnel-like tandemly disposed chutes 82, 84 and 86 replace downstream chute 74 as shown in FIG. 1. In this case, particle deflection barriers 76*a* and 76*b*, if desired, are adjustably mounted on a frame (not shown) and interposed of chutes 82, 84 and 86.

Furthermore, tandemly disposed uniform particle receiving wagons 88, 90 and 92 replace the particle receiving wagon 80, below chutes 82, 84 and 86 respectively. Instead of the funnel-like chutes and the wagons below the aperture 36, the use of the surface 77 alone for particle collection is contemplated. Alternatively, the wagons may be positioned directly below the aperture 36, in lieu of the funnel-like chutes 72 and 74. Also contemplated is the use of conveyors positioned below the funnel-like chutes or the aperture 36.

If desired, a duct 100 joins the walls 28, 30, 32 and 34 of the outlet duct at 100*a* to the walls 38, 40, 42 and 44 of the rear duct at 100*b*, for recirculating the exiting air stream back to the passage entry 100*b*. In this case, the protective guard having walls 58, 60, 62 and 64 is removed.

Generally, a filter unit 102 is in the conducting duct 100 to collect particles while minimizing the pressure drop across the filter. This filter unit may have a plurality of filters 102*a* having at least one filter of charcoal, fibre, electrostatic or other material as is known to those skilled in the art. This filter unit may also be of a cyclone separator type which is known. If desired, a secondary fan may be coupled with the recirculating duct to increase the air pressure therein, as is known.

METHOD

During operation, an air stream, generated by fan 56, enters the passage through protective guard screen 65. The protective guard screen 65 prevents unwanted material from coming into contact with fan blades or travelling there through.

The air stream, proceeds through the diffusing screens 54, 52, 50 and 48, located in the diverging duct, defined by walls 38, 40, 42 and 44, wherein random disturbances in the air stream caused by protective guard and the fan, are dispersed to yield a substantially laminar air stream. The substantially laminar flow of air progresses into the converging duct, defined by walls 18, 20, 22 and 24 wherein the air flow is accelerated to a high velocity, ranging from 15 to 35 feet per second. Within the boundries defined by the walls of the converging duct, this velocity inherently defines a Reynold's number exceeding 4000 as is known to those skilled in the art.

This high velocity turbulent air stream exits the converging duct and simultaneously enters the large hood defined by the walls 12, 14, 16 and 26, wherein the cohesively bonded particles, generally in lumps, are fed in the upper section to be fragmented into individual particles and classified. A rough fragmentation wherein the weaker bonds are broken thereby reducing the size of some lumps of cohesively bonded particles may be done, prior to feeding into the hood, by agitating feeders as discussed under 68. The feeding of these roughly fragmented particles may be slowed by the screen 70*c* to substantially evenly deposit them into the high velocity turbulent air stream.

In the embodiment as shown in FIG. 1, the entry of the turbulent air stream from the converging duct causes a flow of decreasing velocity to be generated in the large hood. The high velocity turbulent air stream interacts with the slower moving air in the lower section of the large hood and forms a mean vertical velocity gradient in the air stream contained by the large hood. This generates a first upper zone in the air stream having a high velocity and thereby inherent turbulence to break the bonds between the cohesively bonded particles, generally present as lumps, and a lower zone of lower velocity whereby the individual particles are classified according to their size. A large portion of the air flow exits the large hood via the outlet duct defined by walls 28, 30, 32 and 34 while the remaining portion exits the large hood via the aperture 36.

In the embodiment employing the conducting duct 100, the previously exiting air stream from the outlet duct proceeds through the conducting duct 100 to the filter 102, wherein generally extra fine particles are entrained in the air stream and collected as they pass therethrough before returning the air stream to inlet at **100*b***.

In the upper portion and at the upstream end of the large hood, the high velocity, and inherently turbulent stream of air impinges on the bonded particles to break them apart or fragment them into particles. Upon further displacement by the high velocity turbulent air stream, the particles each follow a downward curved trajectory path, a function of the air velocity and of the gravitational force on each of the particles.

In a particular embodiment the fragmented particles leave the upper high velocity, high turbulent air stream portion and enter a lower or downstream air stream portion having lower velocity and reduced turbulent disturbances, to enter their respective trajectories thereby further improving particle classifications.

As a result, these trajectories are gradiently disposed with respect to particle size, whereby the downstream displacement of the in-trajectory particles decreases as a direct function of particle mass and increases as a direct function of mean particles cross-section areas. The in-trajectory particles are then collected. The in-trajectory particles may be collected by allowing them to exit the large hood via aperture 36 and to accumulate on a surface 77 thereunder.

Another particle collecting method involves collecting the in-trajectory particles, exiting the large hood through aperture 36, in wagons 78 and 80 positioned in tandem on surface 77 thereunder.

A further method of collecting the in-trajectory particles involves the funnel-like chutes, as shown by chutes 72, 74, 82, 84 and 86, positioned in tandem below aperture 36 of the large hood. The chutes, in turn, direct the particles to collectors, including a surface, wagons as shown in FIG. 1, or to the input ends of further processing machines or other receptacles.

Conveyor belts may also be used to collect the in-trajectory particles. In this case, the conveyors may be placed beneath the funnel-like chutes or the aperture 36 to transport the particles to further processing machines or receptacles.

Should the collection rate at any of the collectors need increasing, one or more of particle deflection barriers 76, **76*a* and 76*b*** may be adjusted to enter the inner region of the large hood, thereby interupting a portion of the curved downward trajectories. As a result, the interupted trajectories are deflected and superposed on other non-interupted trajectories. The particles following these superposed trajectories are deflected into an alternate collector which thereby increases not only the collection rate in the alternate collector but also the range in particle sizes entering the collector.

Having described the invention, modifications will be evident to those skilled in the art without departing from the spirit of the invention, as defined in the appended claims.

We claim:

1. A method of fragmenting cohesively bonded particles into fragmented particles and classifying said fragmented particles according to their size; said method comprising: generating a laminar stream of air, gradually and constantly converging said laminar stream of air to a focal point to accelerate said laminar stream of air to produce a high velocity stream of air, allowing said high velocity stream of air to generate near said focal point, a high velocity turbulent stream of air having a Reynold's number of at least 4000 and a mean velocity ranging from 15 to 35 feet per second, directing said turbulent stream substantially continuously perpendicular to gravity, allowing at least a portion of cohesively bonded particles to fall across the upstream end of said turbulent stream to fragment them into fragmented particles; confining the uppermost portion of said stream to produce a gradual, regular and continuous, horizontal and downward expansion and thereby producing a gradually, continuously, horizontally and downwardly decreasing velocity of said stream, said gradually, continuously, horizontally and downwardly decreasing stream velocity enabling further displacing of said fragmented particles, to classify them as to allow each of said fragmented particles to define respectively a substantially continuously downward curved trajectory according to its size, in reaction to gravity and to said stream of decreasing velocity, all of said trajectories being gradiently disposed according to particle size, and collecting at least one portion of said fragmented particles so classified.

* * * * *